US005897839A

United States Patent [19]

Jackson et al.

[11] Patent Number: 5,897,839

[45] Date of Patent: Apr. 27, 1999

[54] MODIFIED TEST TUBE AND TEST TUBE RACK THEREFOR

[76] Inventors: Milton L. Jackson; Jenny A. Barajas, both of 4113 Chester Dr., Ypsilanti, Mich. 48197

[21] Appl. No.: 08/848,573

[22] Filed: Apr. 28, 1997

Related U.S. Application Data

[63] Continuation-in-part of application No. 08/762,773, Dec. 10, 1996.

[51] Int. Cl.[6] ..... B01L 3/00

[52] U.S. Cl. ..... 422/102; 422/99; 422/104; 206/443; 206/563; 211/74

[58] Field of Search ..... 422/58, 61, 99, 422/100, 102, 104; 206/443, 563; 211/74

[56] References Cited

U.S. PATENT DOCUMENTS

| | | | |
|---|---|---|---|
| D. 296,928 | 7/1988 | Lee et al. | D24/32 |
| 1,312,340 | 8/1919 | Mojonnier | 422/100 |
| 1,660,974 | 2/1928 | Porro | 422/102 |
| 2,288,065 | 6/1942 | Benotti | 422/102 |
| 2,625,823 | 1/1953 | Erickson | 422/102 X |

OTHER PUBLICATIONS

VWR Scientific catalog, p. 210, showing Nunclon™ Δ flat sided and culture tubes.

Corning Glassware catalog, 1995, p. 265, showing tube with flat window and showing tube with sidearm.

James W. Queen and Co. catalog, circa 1875, pp. 22–23, showing side neck test tube and ignition tube.

*Primary Examiner*—Harold Y. Pyon

*Attorney, Agent, or Firm*—David P. Gordon; David S. Jacobson; Thomas A. Gallagher

[57] ABSTRACT

A modified test tube is provided which can sit on any flat surface unaided by a test tube rack. The modified test tube includes a tubular containment portion and tubular neck portion. The containment portion has a bottom surface preferably provided with a plurality of legs and a closed end. The neck portion is angled approximately 45° relative to the flattened surface and has a mouth which opens parallel to the flattened bottom surface. The legs enable the test tube to sit prone on any flat surface by itself, unaided by a rack, and the bent neck portion prevents the contents from spilling from the test tube. This design enables the contents within the test tube to be easily monitored without moving the test tube. A test tube rack is further provided for storing the test tubes. The test tube rack is generally a rectangular member having a plurality of cavities, spaced such that each does not intersect another. The cavities are preferably provided with openings alternately provided in opposite sides of the rack.

12 Claims, 9 Drawing Sheets

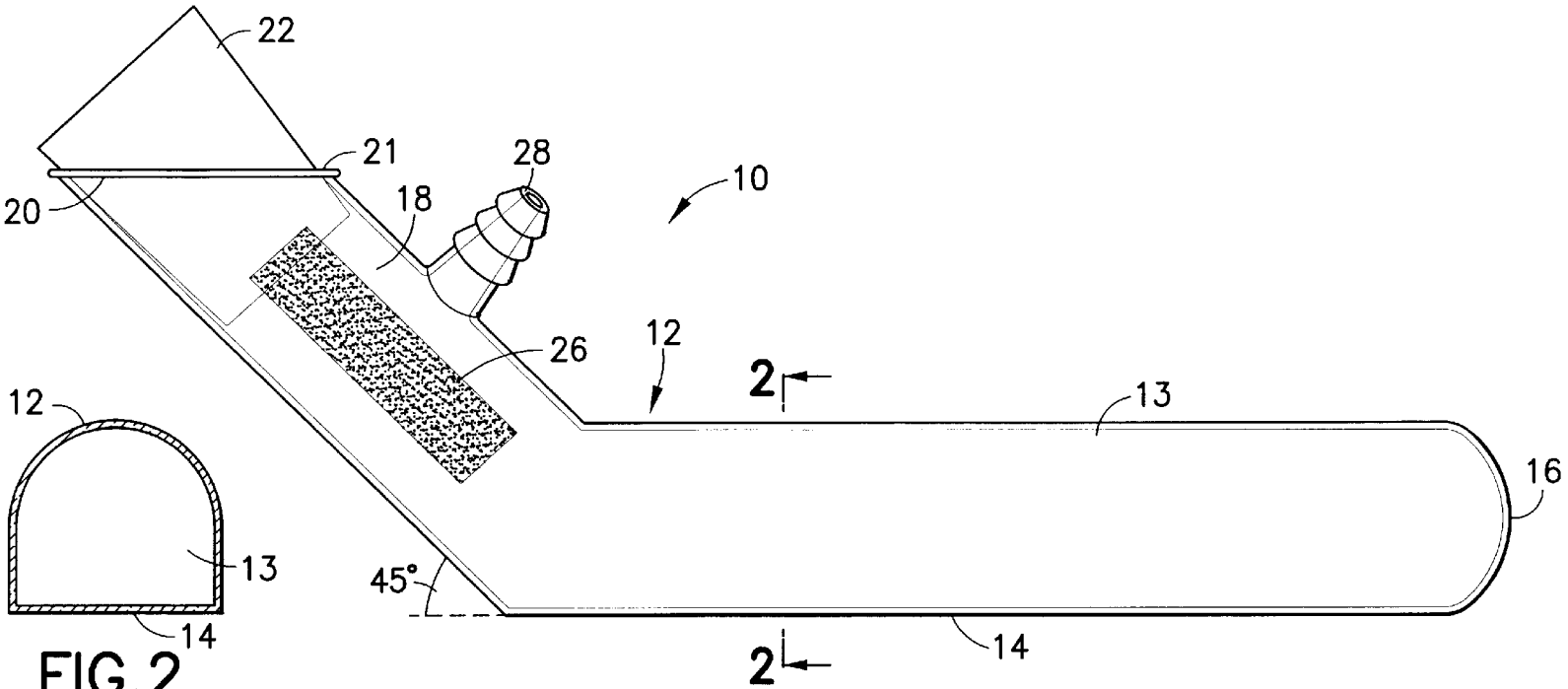
FIG. 1
FIG. 2
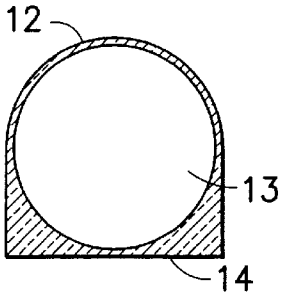
FIG. 2A

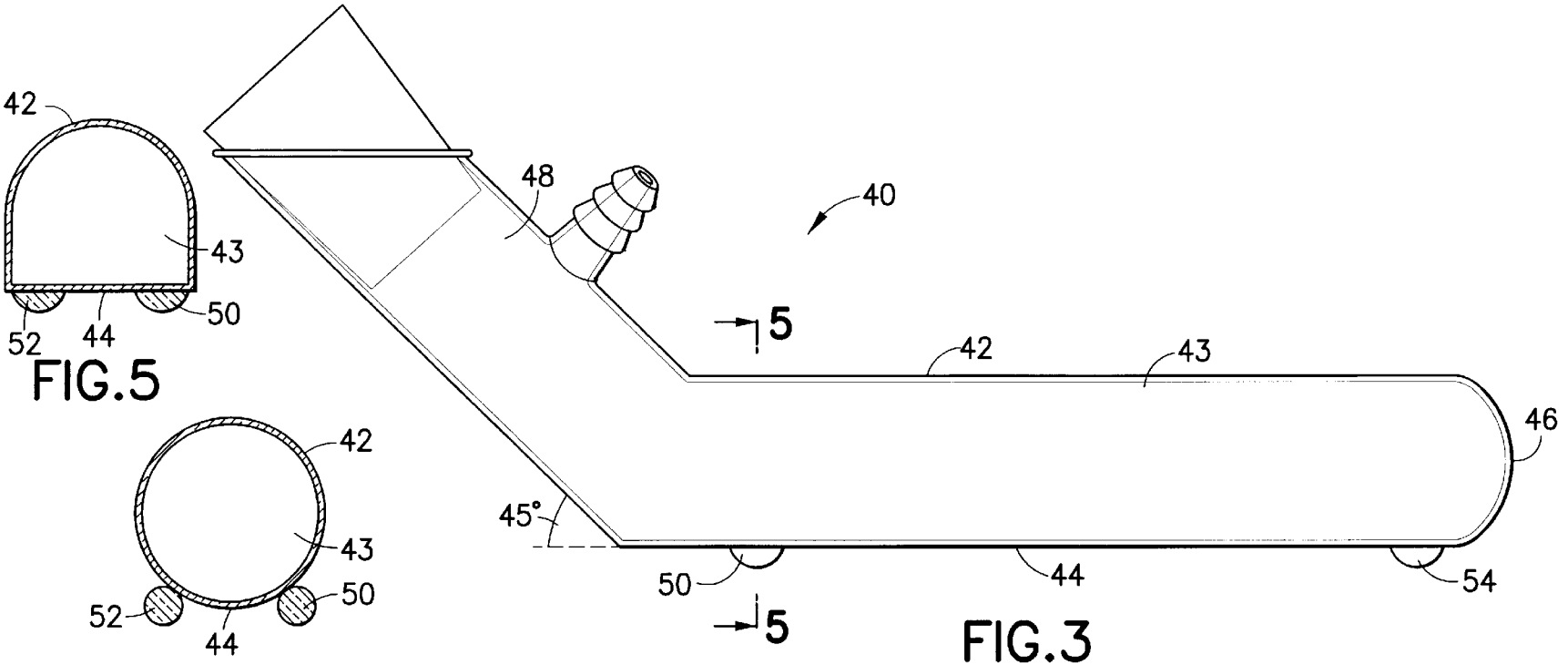
FIG.3
FIG.5
FIG.5A
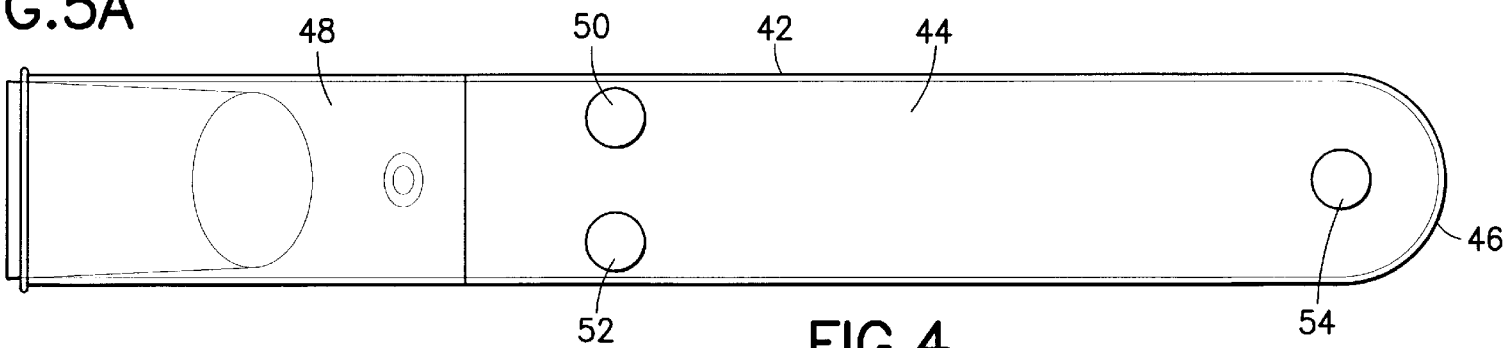
FIG.4

MODIFIED TEST TUBE AND TEST TUBE RACK THEREFOR

This application is a continuation-in-part of U.S. Ser. No. 08/762,773, filed Dec. 10, 1996 which is hereby incorporated by reference herein in its entirety.

BACKGROUND OF THE INVENTION

1. Field of the Invention

This invention relates broadly to laboratory equipment. More particularly, this invention relates to test tubes and test tube racks.

2. State of the Art

Standard test tubes are tubular in shape and have a rounded sealed bottom end and an open top end. The standard test tube design possesses a high degree of utility in laboratory experimentation and research. In fact, it is anticipated that the standard shape test tube will continue to dominate the test tube market due to its simplicity and design familiarity. Yet, this dominance is in spite of drawbacks associated with the standard design.

Standard test tubes require the use of a rack for support, as the test tubes cannot stand on their own. Unless the open end of a standard test tube is closed with a stopper, when the test tube is placed on a flat surface without the use of a rack, the contents of the test tube will spill out. Therefore, standard test tubes, regardless of size, generally require the use of a test tube rack to hold the test tubes while the test tubes are being utilized. As a result, when placing a standard test tube into a heated water bath, the test tube must first be placed into a test tube rack and then the entire rack must be inserted into the water, such that the test tubes are substantially submerged. This results in more time and energy needed to bring the contents of the standard test tubes to the desired temperature. Furthermore, as a substantial portion of the standard test tube is submerged in the water bath, it is difficult to monitor reactions occurring within the test tube. Moreover, when applying heat to a standard test tube, it is common to place the test tube in a clamp and to apply a flame under the test tube. This often provides uneven heating of the contents, as heat is applied primarily only under the bottom of the test tube and may cause the contents at the bottom of the tube to scorch. In addition, standard test tubes cool slowly as cool air will only come into contact with a small surface area of the contents of the tube. Another disadvantage is that when adding or heating reagents in a standard test tube there is a strong potential for harmful spatter from "bumping" (the rapid evolution of gas bubbles) to occur which can result in sample loss. Furthermore, when adding a substance to a test tube in situations where the substance weight is critical, the substance must first be weighed on weighing paper and then transferred into the test tube. As some of the substance will remain on the weighing paper after the bulk of the substance has been transferred to a test tube, experimental error is introduced into the system.

As discussed above, standard test tubes require a test tube rack. Standard test tube racks usually have upper and lower horizontal holding members and vertical supports. The upper holding member has a plurality of holes arranged in a two dimensional array, each of the holes being slightly larger than the diameter of the standard test tubes which the rack is designed to hold. The lower holding member has a plurality of depressions aligned below the holes of the upper holding member. A standard test tube extends through one of the holes in the upper holding member and seats in the depression aligned beneath the hole through which the test tube extends.

Standard test tube racks, like standard test tubes, also carry substantial disadvantages. First, it is difficult to monitor and observe reactions occurring in a test tube held in a standard rack if the test tube is not located along the edge of the two-dimensional array. This problem is compounded when a large number of tubes fill the rack, making observation of the contents below the mouths of the tubes even more difficult. Second, standard racks require a substantial amount of space, as their design is not generally conducive to stacking. In those racks which are stackable, once the racks are stacked, observation of a test tube within a lower rack is not possible and removal of a test tube from a lower rack requires removing the racks stacked above the lower rack.

SUMMARY OF THE INVENTION

It is therefore an object of the invention to provide a modified test tube which can be seated in a stable position without the use of a test tube rack and can be stood vertically with the use of a conventional test tube rack.

It is also an object of the invention to provide a modified test tube which will not spill when seated prone.

It is another object of the invention to provide a modified test tube which allows relatively easy monitoring of the contents of the test tube.

It is an additional object of the invention to provide a modified test tube which permits even heating of its contents.

It is a further object of the invention to provide a modified test tube which permits the contents of the test tube to have a relatively larger area in contact with ambient air.

It is yet another object of the invention to provide a test tube rack for a modified test tube which provides access to each test tube located therein when stacked below another test tube rack.

It is yet a further object of the invention to provide a test tube rack for a modified test tube which enables observation of the contents of each of the test tubes held in the rack.

In accord with these objects which will be discussed in detail below, a modified test tube is provided which can sit on any flat surface unaided by a test tube rack. The modified test tube is an elongate, substantially tubular member defining a containment portion and a neck portion. The containment portion has a closed end and a flattened bottom surface or, alternatively or additionally, legs along the bottom surface. The neck portion has a mouth. The neck portion is angled approximately 45° relative to the bottom surface and the mouth opens parallel to the bottom surface. In addition, a test tube rack is provided for housing the modified test tubes. The test tube rack has a plurality of cavities which are preferably centrally inclined and shaped for receiving the containment portion of the modified test tubes.

It will be appreciated that the feet on the bottom surface of the modified test tube enables the test tube to sit on any flat surface by itself, unaided by a rack, and that the angled neck portion prevents the contents from spilling from the test tube. Additionally, the modified test tube may be used in the vertical position and is, accordingly, compatible with standard test tube racks and other conventional laboratory equipment. It will also be appreciated that this design enables the contents within the modified test tube to be easily monitored and observed without moving the test tube, which is usually required when a standard test tube is seated in a rack. The modified test tube may also be placed directly into a water bath without the use of rack. In addition, the contents of the modified test tube may be more evenly heated as heating can be done with the test tube in a prone orientation, and the prone configuration of the test tubes provides the contents with an increased surface area, thereby reducing the potentially harmful spatter from "bumping" and permitting the contents to cool more rapidly and evenly. Furthermore, an empty modified test tube can easily be placed on a zero balance scale and substances can be added directly to the test tube without the necessity of weighing paper.

A test tube rack designed to particularly take advantage of the improvements offered by the modified test tube is also provided. The test tube rack is generally a structure having a plurality of cavities, spaced such that each does not intersect another, or a plurality of holes in the thick walls of a structure. The cavities or holes may be arranged into several horizontal levels.

Additional objects and advantages of the invention will become apparent to those skilled in the art upon reference to the detailed description taken in conjunction with the provided figures.

BRIEF DESCRIPTION OF THE DRAWINGS

FIG. 1 is a side elevation view of a first embodiment of the modified test tube of the invention;

FIG. 2 is a cross-section across line 2—2 of FIG. 1;

FIG. 2A is a cross-section of an alternative first embodiment across line 2—2 of FIG. 1;

FIG. 3 is a side elevation view of a second embodiment of the modified test tube of the invention;

FIG. 4 is a bottom view of the second embodiment of the invention;

FIG. 5 is a cross-section across line 5—5 of FIG. 3;

FIG. 5A is a view similar to that of FIG. 5 of an alternative second embodiment of the invention;

DETAILED DESCRIPTION OF THE PREFERRED EMBODIMENTS

Figure 6:
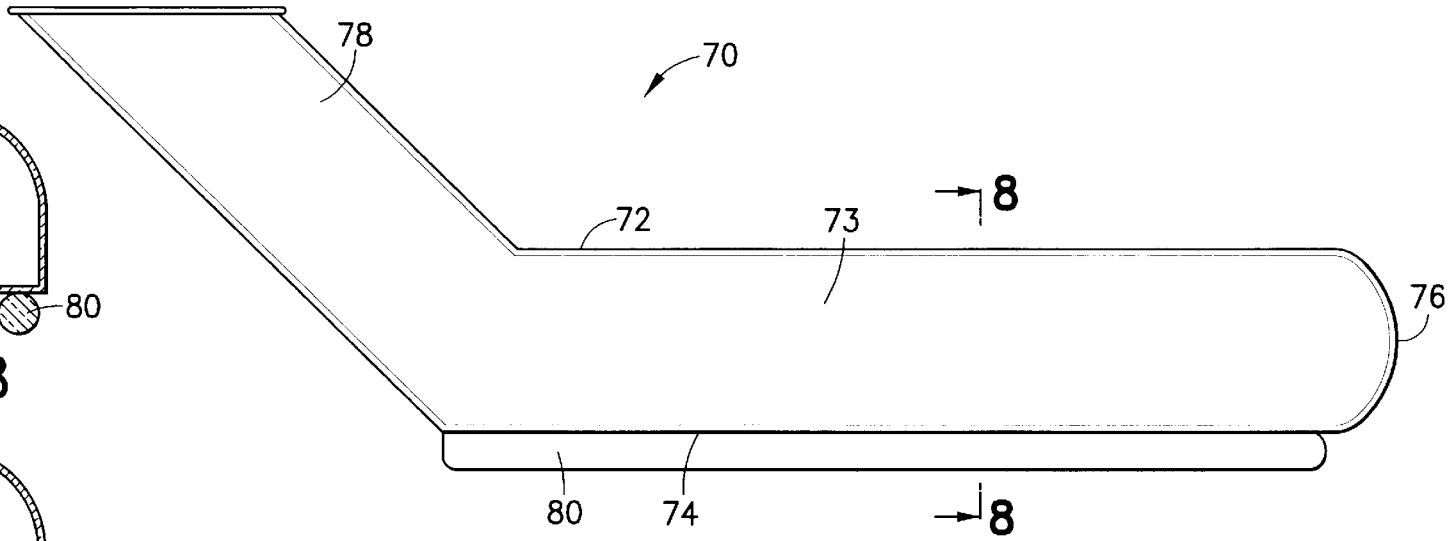
FIG. 6 is a side elevation view of a third embodiment of the modified test tube of the invention.

Turning now to FIG. 1, a first embodiment of a modified test tube 10 according to the invention is shown. The modified test tube 10 is a preferably transparent, substantially tubular member 12, preferably made of glass or plastic. The tubular member 12 has a containment portion 13 coupled to a neck portion 18. The containment portion 13 has a flattened bottom surface 14, a closed end 16. The interior of the containment portion may be non-circular in cross-section (FIG. 2) or generally circular or ovoid in cross-section (FIG. 2A). The neck portion 18 is angled upwards approximately 45° relative to the flattened bottom surface 14 and has a mouth 20 substantially parallel to the flattened bottom surface. The mouth 20 preferably has a lip 21, and can be sealed with a standard rubber stopper 22. Alternatively, the mouth can include an external thread (not shown) which receives a threaded cap (not shown). A roughened or frosted patch 26 is provided on the surface of the neck 18 providing a surface on which to mark the test tube with a pen or pencil or to apply a bar code. A side arm 28 for connection a siphoning tube to the test tube may also be provided on the neck 18 (shown) or on the containment portion 13 (not shown).

It will be appreciated that the flattened surface enables the test tube to sit prone on any flat surface by itself, unaided by a rack, and that the bent mouth portion prevents the contents from spilling from the test tube while prone. As such, a number of advantages are realized over the standard test tube design. It will also be appreciated that the closed end of the modified test tube is designed to fit in a standard test tube rack, as well as in other conventional laboratory equipment, e.g. clamps.

Referring to FIGS. 3 and 4, a second and presently preferred embodiment of an improved test tube 40, substantially similar to the first embodiment, is shown. The modified test tube 40 is a tubular member 42 having a containment portion 43 coupled to a neck portion 48. The containment portion 43 has a bottom surface 44, and a closed end 46. The bottom surface 44 is provided with lateral feet 50, 52 and a central foot 54. The feet 50, 52, 54 are preferably balls or globs of glass or plastic applied or affixed to the bottom surface 44. The interior of the containment portion 43 is shown in FIG. 5 to be non-circular in cross-section, although, as seen in FIG. 5A, a generally circular or ovoid cross-section may be provided. It will be appreciated that the feet 50, 52, 54 enable the test tube to sit prone on any flat surface by itself, unaided by a rack, and further eliminate direct contact between the bottom surface 44 and the surface upon which the tube is seated.

It will be appreciated that the second embodiment provides further advantages over the first embodiment. When heating the contents of the tube by placing the tube directly on a hot plate, it is undesirable to have contact between the bottom surface 44 and the surface of the hot plate, as contact may increase "bumping". The legs remove contact between the bottom surface and heating surface and thereby reduce the likelihood of "bumping".

Figure 7:
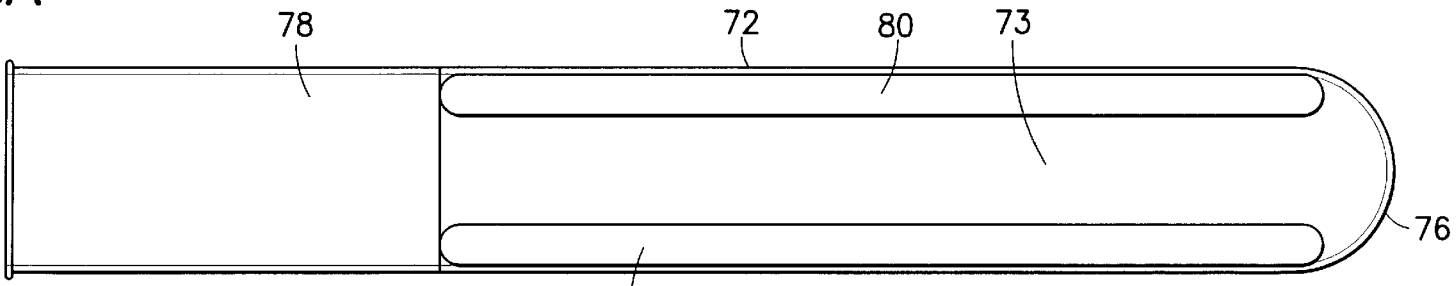
FIG. 7 is a bottom view of the third embodiment of the invention.
Figure 8:
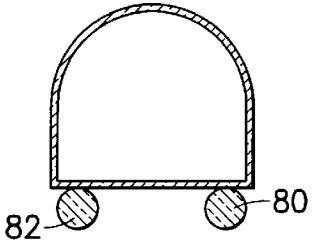
FIG. 8 is a cross-section across line 8—8 of FIG. 6.
Figure 8A:
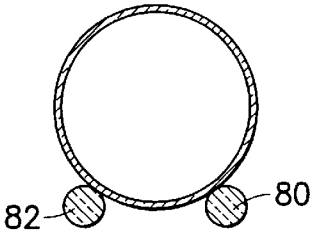
FIG. 8A is a view similar to that of FIG. 8 of an alternative third embodiment of the invention.

Turning to FIGS. 6 and 7, a third embodiment of a modified test tube 70, substantially similar to the first embodiment, is shown. The modified test tube 70 is a tubular member 72 having a containment portion 73 coupled to a neck portion 78. The containment portion 73 has a bottom surface 74 and a closed end 76. Support rails 80, 82 (or elongate legs) are affixed to the bottom surface 74. The interior of the containment portion 73 may be non-circular in cross-section, as seen in FIG. 8, or generally circular or ovoid in cross-section, as seen in FIG. 8A. It will be appreciated that the rails provide the same benefit as that described above, with respect to the feet 50, 52, 54 in the second embodiment.

In order to take advantage of certain of the improvements of the modified test tube and to further offer a radical alternative to the standard test tube rack design, an improved rack for the modified test tube is hereby provided. Turning to FIG. 7, a first embodiment of a test tube rack 100 housing a modified test tube 10 is shown. Generally, the test tube rack 100 is a substantially solid cylinder 102 of a preferably transparent material, e.g., glass or plastic. The solid cylinder 102 has a plurality of radially aligned cavities 110*a*, 110*b*, 110*c* shaped to receive the containment portions 13 of the modified test tubes (including modified test tubes having containment portions with legs or rails). The cavities 110*a*, 110*b*, 110*c* have cavity mouths 112*a*, 112*b*, 112*c* at the periphery of the cylinder 102. The cavities are spaced such that each does not intersect another and may be further arranged into several horizontal levels, e.g., the two layers illustrated in FIGS. 7, 8, and 8. In addition, the cavities are preferably angled downward by approximately 5 to 20 degrees away from their respective mouths 112*a*, 112*b*, 112*c* and toward the center of the cylinder to assist in retaining the modified test tubes. Preferably, the mouths 112*a*, 112*b*, 112*c* are chamfered 113*a*, 113*b*, 113*c* to engage a neck portion 18 of the modified test tube 10 and to keep the test tube in a "neck up" orientation.

Figure 9:
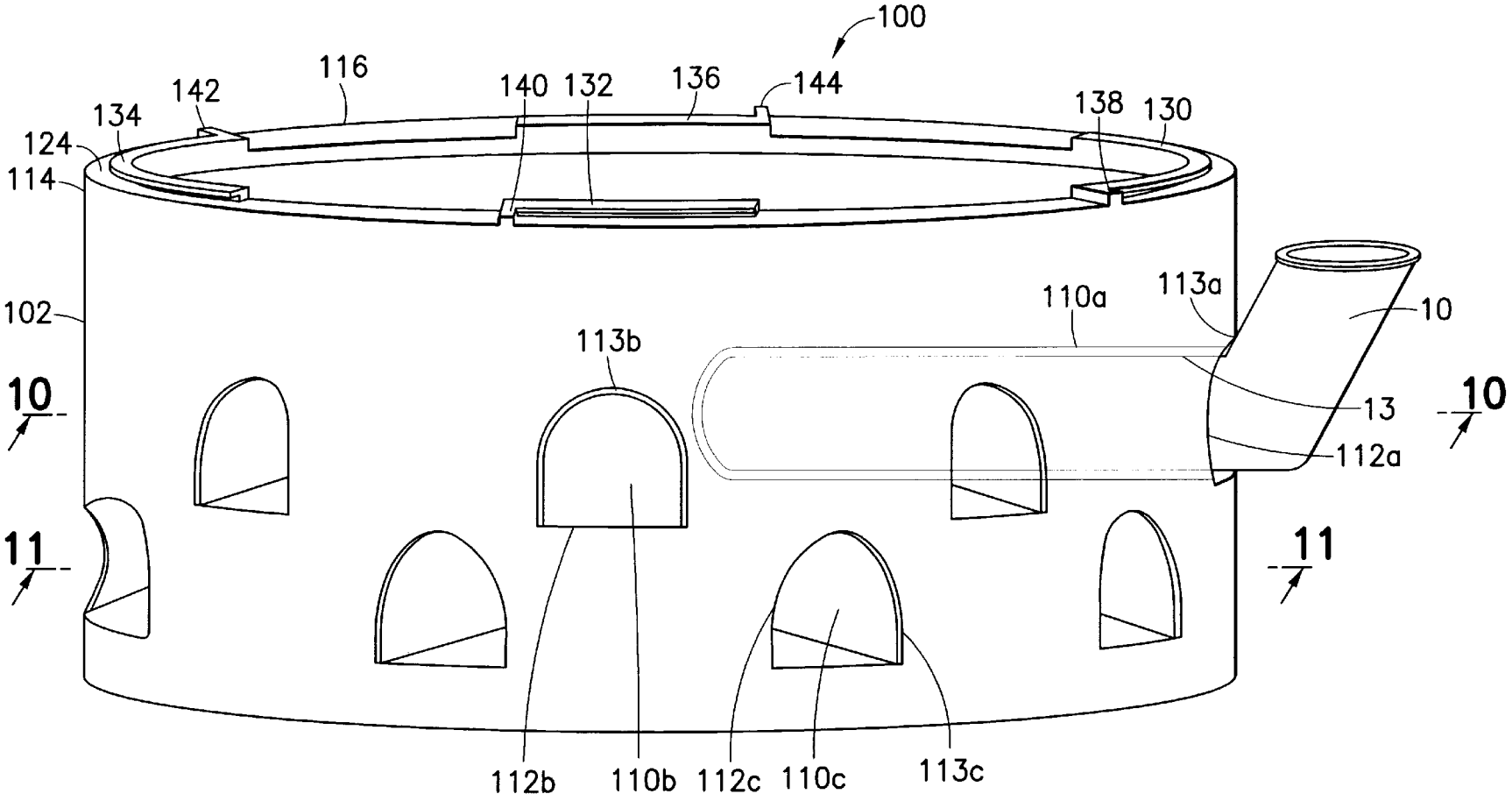
FIG. 9 is a perspective view of a test tube rack according to the invention.
Figure 11:
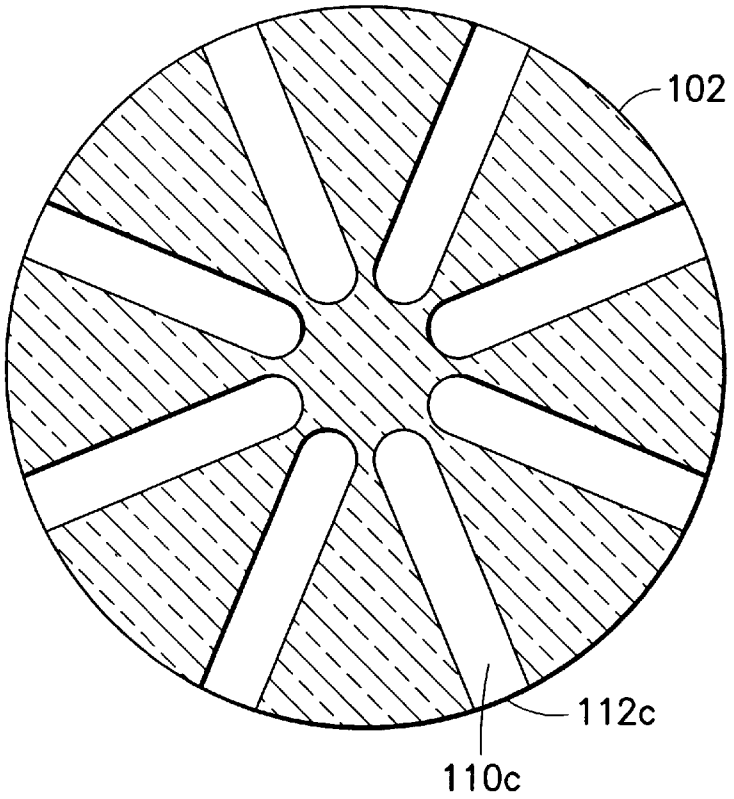
FIG. 11 is a cross sectional view across line 11—11 of FIG. 9.
Figure 10:
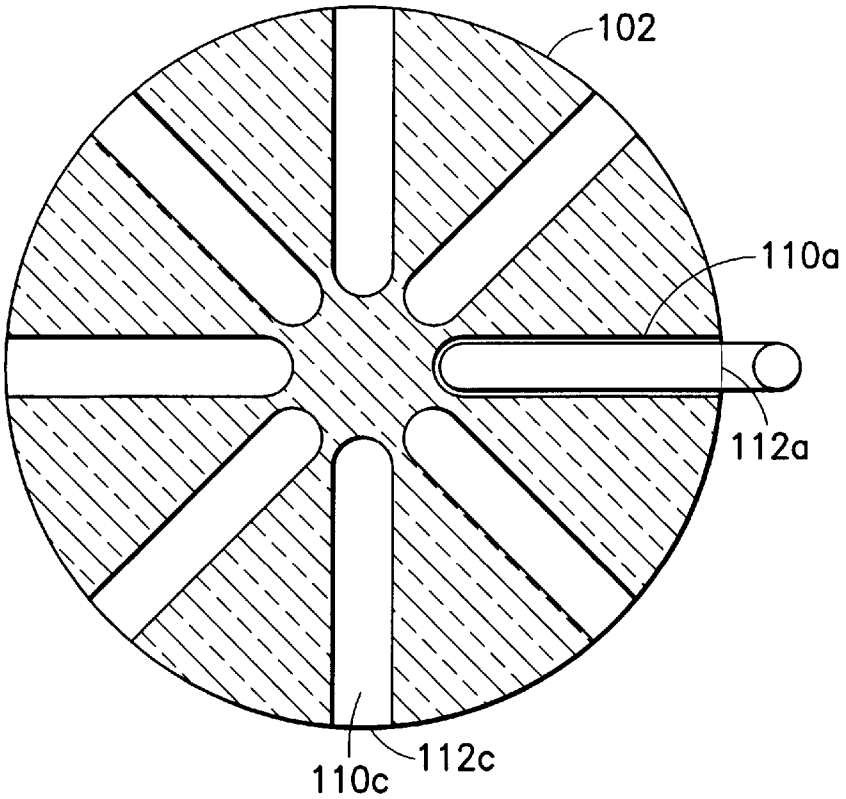
FIG. 10 is a cross-sectional view across line 10—10 of FIG. 9.
Figure 13:
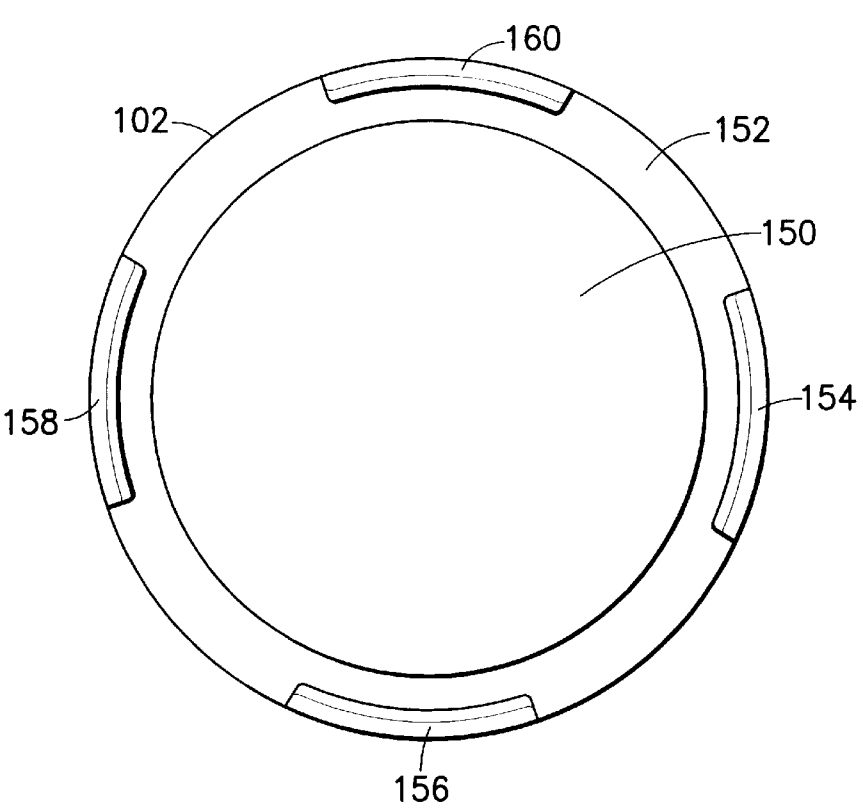
FIG. 13 is a reduced bottom view of the test tube rack shown in FIG. 9.
Figure 12:
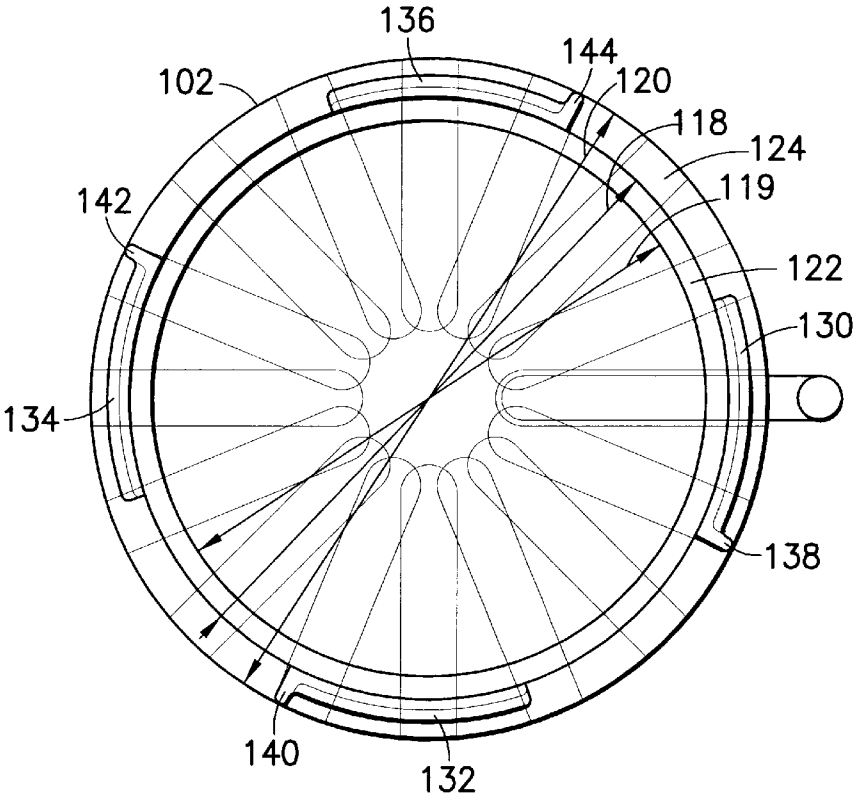
FIG. 12 is a reduced top view of the test tube rack shown in FIG. 9.

Referring to FIGS. 9, 12, and 13, a top portion 114 of the rack 100 includes a wall 116 having an upper inner diameter 118, a lower inner diameter 119, an outer diameter 120, a recessed lower lip 122, and a circumferential channel 124. Several top catch members 130, 132, 134, 136 are provided at the channel 124. Each top catch member 130, 132, 134, 136 rises vertically from the channel 124 adjacent the recessed lower lip 122 and angles approximately 90° towards the periphery of the rack, extending across a portion of the channel 124. One end of each of the top catch members, but the same side for each, is provided with a stop 138, 140, 142, 144 which is orthogonal to both the rising and peripherally extending portions of the catch members 130, 132, 134, 136.

Referring to FIGS. 9 and 13, the bottom of the rack includes a bottom surface 150 and a recessed peripheral lip 152. The bottom surface 150 supports the rack 100 when the rack is seated on a flat surface, and has a diameter substantially the same as the upper inner diameter 118. The recessed peripheral lip 152 is provided with a plurality bottom catch members 154, 156, 158, 160 descending from the outermost periphery of the recessed lip, then angling approximately 90° towards the central axis (axis of rotation) of the cylindrical member 102, and extending across a portion of the peripheral lip 152.

Figure 15:
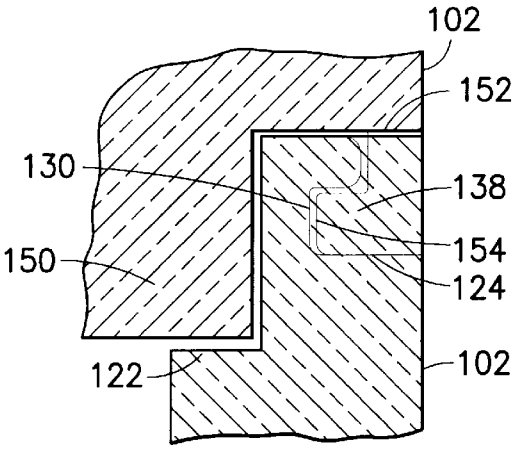
FIG. 15 is a cross-sectional view across line 15—15 of FIG. 14.
Figure 16:
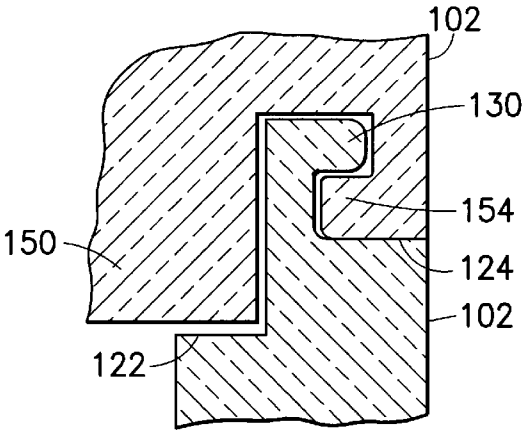
FIG. 16 is a cross-sectional view across line 16—16 of FIG. 14.
Figure 14:
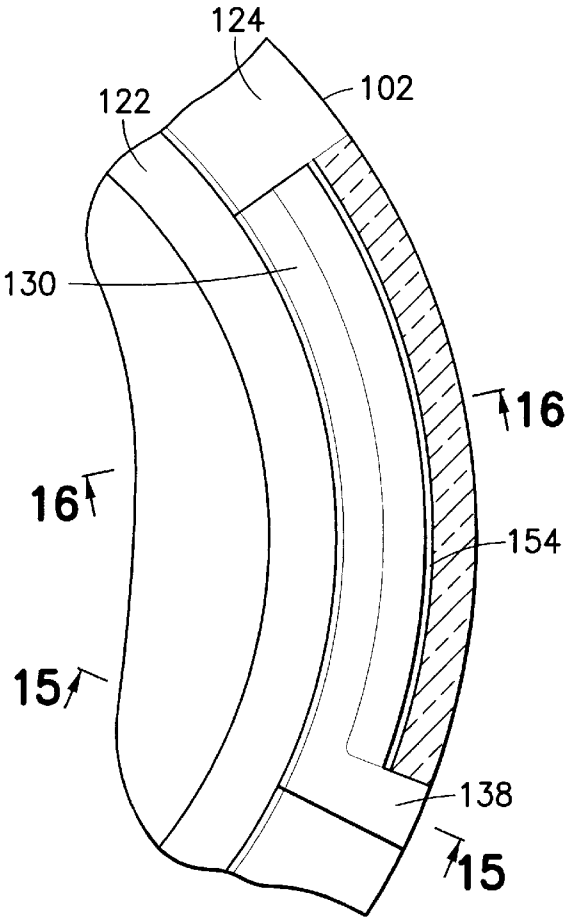
FIG. 14 is an enlarged broken partial top view of the locking mechanism of the test tube rack of the invention.

It will be appreciated that several racks may stacked one on top of another. With respect to a stack of two racks, the bottom surface of the upper rack seats into the recessed lower lip at the top of the lower rack. The top catch members and the bottom catch member are initially aligned such that the bottom catch members lie between the top catch members. Once the two stacks are in such alignment, the rack upper in the stack is rotated relative to the rack lower such that corresponding top and bottom catch members interlock and the two racks are secured relative to each other, as illustrated in FIGS. 14, 15, and 16. Stops 138, 140, 142, 144 on the catch members prevent further rotation in one rotational direction when the bottom catch member abuts the stop. It will be appreciated that more than two racks may be likewise secured in a stack in the same manner. It will be further appreciated that every test tube in each of the racks of a stack remains relatively visible, relatively observable, and immediately accessible.

Figure 17:
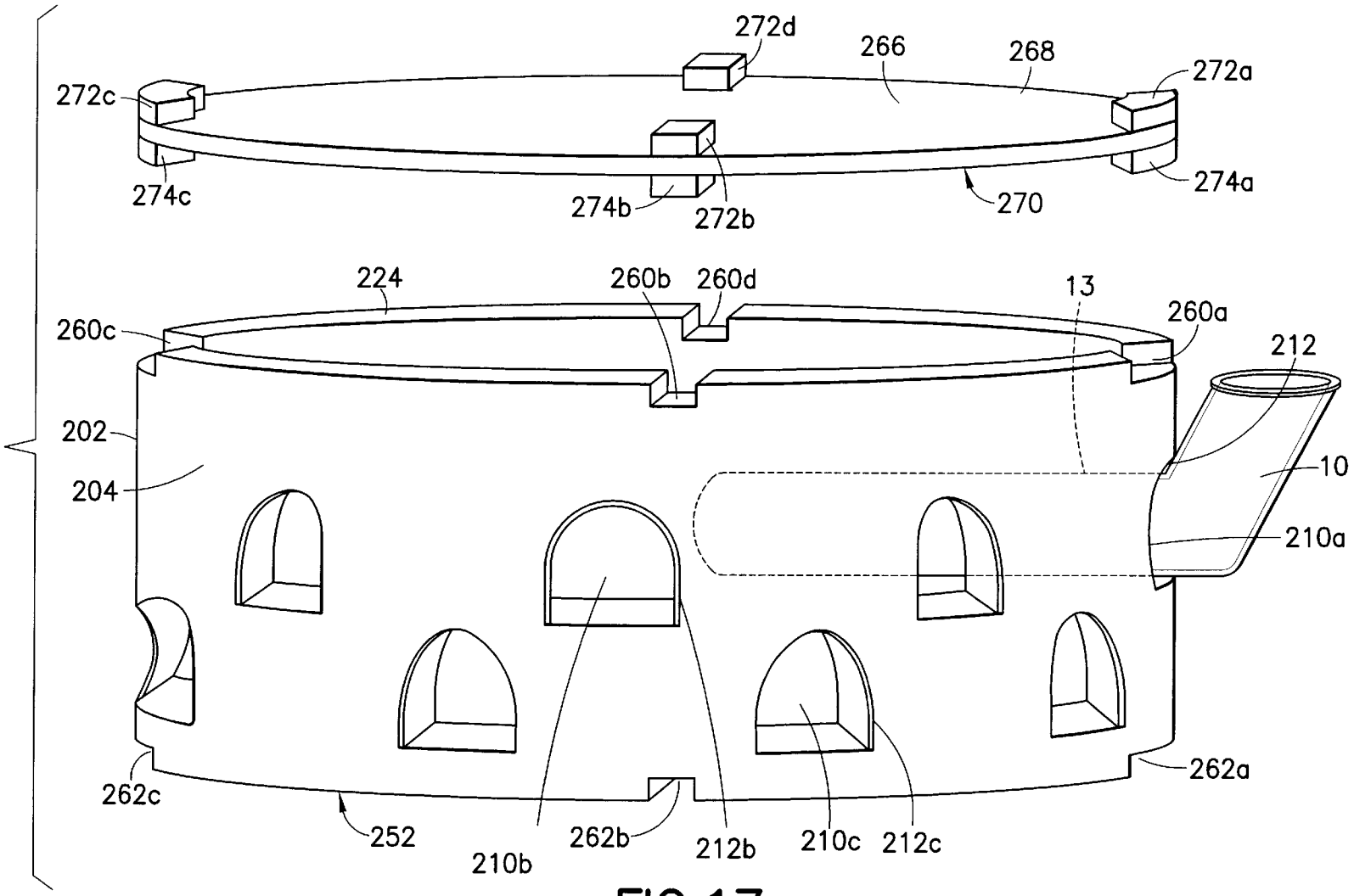
FIG. 17 is an exploded perspective view of a second embodiment of the test tube rack of the invention.

Turning now FIG. 17, a second embodiment of the test tube rack, substantially similar to the first embodiment (with like parts have similar numbers incremented by 100), is shown. The test tube rack 200 is a tubular member 202, preferably of a transparent material, having a relatively thick wall 204 defining a plurality of cavities or holes 210*a*, 210*b*, 210*c* shaped to receive the containment portions 13 of the modified test tubes 10. The holes 210*a*, 210*b*, 210*c* include a mouth or entrance 212*a*, 212*b*, 212*c* which may be chamfered to engage a neck portion 18 of the modified test tube 10. The thickness of the wall 204 is such that support is provided for a test tube 10 extending through a hole without any further support for the test tube. The thick wall 204 has an upper lip 224 and a bottom lip 252. The top lip 224 is provided with several notches 260*a–c* at regular intervals around the circumference of the top lip. Likewise the bottom lip 252 is provided with several notches 262*a–c* (262*d* not shown). A disc-shaped connecting cover 266 is provided as a cover for the rack and as a means for easily stacking the racks. The connecting cover 266 has an upper side 268 and a lower side 270. The upper side 268 has several upper nubs 272*a–d* around the periphery of the upper side 268 of the cover, of a shape, size and number corresponding to the notches 260*a–d* provided in the top lip. Likewise, the lower side 270 has several lower nubs 274*a–d* (274*d* not shown) around the periphery of the lower side 270 of the cover, of a shape, side and number corresponding to the notches 262*a–d* provided in the bottom lip 252. The connecting cover is applied over the upper lip 224 of the lower rack in the stack such that lower nubs 274*a–d* on the lower side 270 of the connecting cover seat in the notches 260*a–d* of the upper lip 274. The upper rack in the stack is then seated onto the connecting cover 266 such that the notches 262*a–d* seat on the upper nubs 272*a–d* on the upper side 268 of connecting cover 266. As a result, the racks can be stacked in a relatively stable manner, and similar advantages are attained as in the first embodiment. It will be appreciated that the connecting cover further serves as a divider between a stack of racks preventing any material, e.g. a broken test tube, from falling through a lower rack in a stack. It will be further appreciated that the connecting cover can be designed to be integral with the top or bottom portions of a rack.

Figure 20:
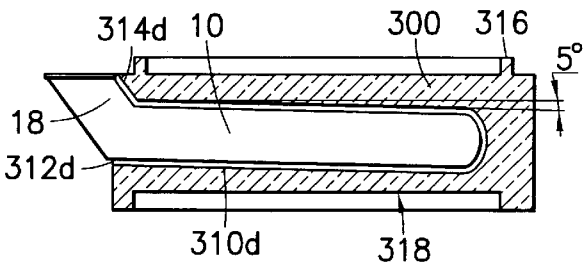
FIG. 20 is a cross-section through line 20—20 in FIG. 18.
Figure 18:
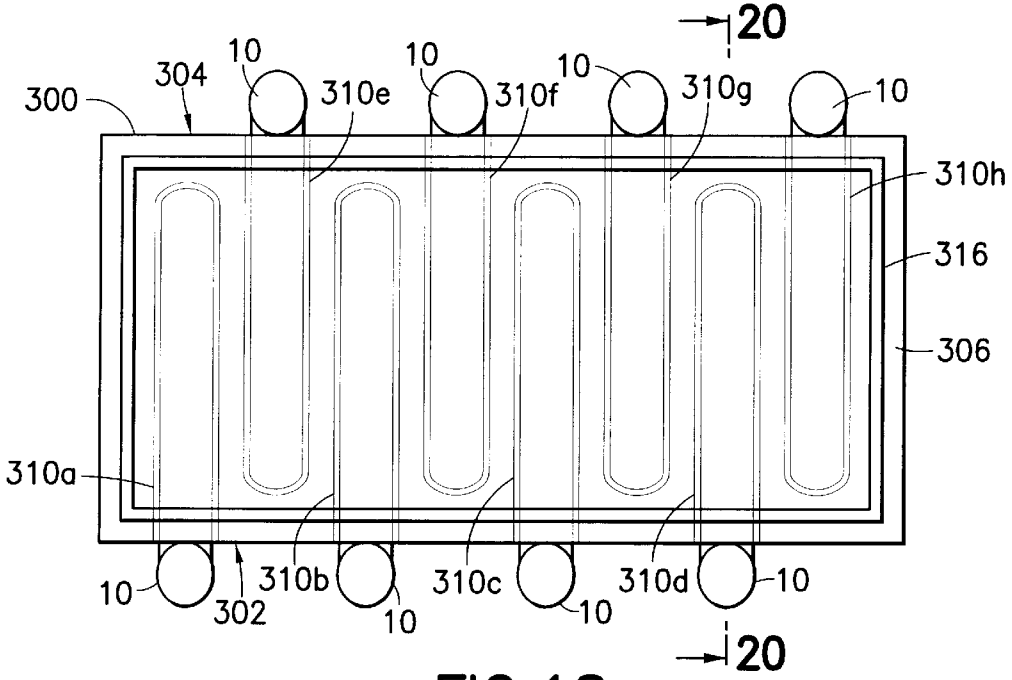
FIG. 18 is a transparent top view of a third embodiment of a test tube rack of the invention.
Figure 19:
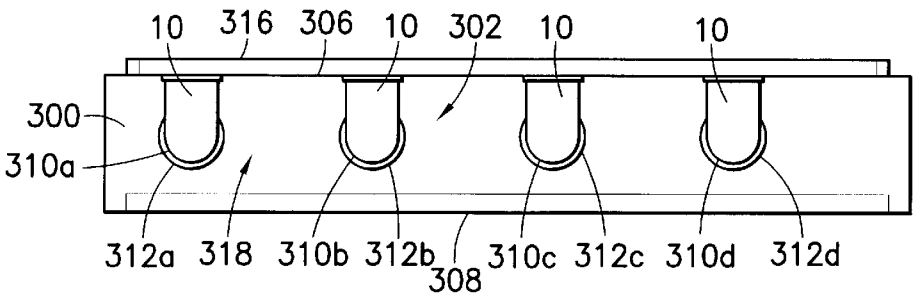
FIG. 19 is a side elevation of the test tube rack of FIG. 18.

Turning to FIGS. 18 through 20, a third and presently preferred embodiment of a test tube rack is shown. The test tube rack 300 is preferably rectangular in shape and includes a first side 302, a second side 304, a top surface 306, and a bottom surface 308. The rack 300 is provided with a plurality of cavities 310*a–h* for receiving modified test tubes 10, and preferably for receiving modified test tubes 40, 70 having legs, as described above. The cavities 310*a–h* have mouths 312*a–d* (312*e–h* not shown) which are preferably formed at the first side 302 and at the second side 304 to alternately receive test tubes from the first and second sides 302, 304. In addition, the cavities 310*a–h* are preferably angled downward by approximately 5 to 20 degrees away from their respective mouths 312*a–h*. Moreover, the cavities are preferably provided with a non-circular cross-section. The first side 302 of the rack is preferably bevelled, as shown at 314*d*, around the upper portion of the mouths to receive the neck portion 18 of the modified test tube and thereby hold the test tube in a "neck up" orientation. The top surface 306 of the rack is preferably provided with a lip 316 and the bottom surface 308 is preferably provided with a recess 318 for receiving the lip of another rack, thereby securably stacking two racks and having the ability for stacking three or more racks.

There have been described and illustrated herein several embodiments of a test tube and a rack for receiving the test tube. While particular embodiments of the invention have been described, it is not intended that the invention be limited thereto, as it is intended that the invention be as broad in scope as the art will allow and that the specification be read likewise. Thus, while glass and plastic have been disclosed as materials for constructing the test tube and the rack, it will be appreciated that other materials may be used as well. Also, while three legs or two rails have been shown on the bottom surface of the test tube, it will be appreciated that fewer or more than three legs or two rails may be so provided for seating the test tube. For example, two legs may be provided adjacent the closed end of a modified test tube such that the two legs and the transition from the containment portion to the neck portion together form a tripod. Moreover, the tripod may be arranged to raise the closed end relative to the transition from the containment portion to the neck portion, thereby causing contents within the containment portion of the test tube to flow toward the transition area. In addition, the legs or rails may extend from the side of the test tube rather than from the bottom surface of the test tube. Furthermore, while the legs and rails have been described as being "applied or affixed" to the bottom surface, it will be appreciated that the legs or rails may be otherwise formed to the test tube, including integrally forming legs or rails to the test tube during the test tube forming process. Moreover, while a stopper and a screw top have been disclosed for sealing the test tube, it will be understood that other sealing means can be similarly used. For example, the mouth can be modified for an aerobic/anaerobic cap if desired. In addition, the inside of the containment portion can be circular, oval, or otherwise shaped. Furthermore, the connection between the containment and neck portions can be as shown or curved. Moreover, while the neck is disclosed to angle upwards approximately 45° relative to the flattened bottom surface or to the legs, it will be appreciated that the angle may be greater than or less than 45°, as the exact angle is not critical. Rather, what is critical is that the angle of the neck portion relative to the containment portion in conjunction with the length of the neck relative to the length of the containment portion should provide a test tube which can be seated in a stable position on its flattened bottom surface or legs or rails and further provide a mouth location that will prevent the test tube contents from spilling therefrom when the test tube is so seated. Also, the diameter of the neck and containment portions can be substantially the same or different. In addition, while a single side arm is shown on the neck portion of the test tube, it will be appreciated that one or more side arms may likewise be provided on the neck portion or containment portion of the test tube. Furthermore, the mouth opening or lip can be angled relative to or parallel with the flat bottom surface.

In addition, while a rectangular shape is preferred for the rack, it will be appreciated that other shapes, i.e. such that the rack has a triangular or ovoid cross-section, may also be used. Also while the cavities are preferably provided with a 5 to 20 degree declination away from the cavity mouth, it will be appreciated that the cavities may be substantially level or have a lesser or greater degree of declination. Furthermore, while bevels at the mouths of the cavities have been disclosed for maintaining test tubes seated therein in a "neck up" position, it will be appreciated that other means for this purposed may be provided. For example, external vertical walls or pins for abutting the neck portion of a modified test tube may be provided to prevent the test tube from substantially rotating within a cavity. Moreover, if the cavities are provided with a non-circular cross section, the non-circular cross-section will suffice as a means for maintaining the test tubes in a "neck up" position. In addition, it will also be appreciated that while particular designs for interlocking the racks have been disclosed, other manners for interlocking the racks together may be utilized. It will therefore be appreciated by those skilled in the art that yet other modifications could be made to the provided invention without deviating from its spirit and scope as so claimed.

We claim:

1. A test tube adapted to be vertically received into a standard test tube rack having test tube receiving openings with a first cross-sectional area and also adapted to be horizontally self-supporting on a substantially flat surface, comprising:

a) a tubular containment portion having an interior surface having a topmost portion and a lowermost portion substantially parallel with said topmost portion, a substantially horizontal exterior surface substantially parallel with said lowermost portion, said substantially horizontal exterior surface having means for stabilizing said test tube on the substantially flat surface, said containment portion having a second external cross-sectional area substantially the same size as the first cross-sectional area;

b) a closed end coupled to said containment portion; and c) a tubular neck portion having an open end, said neck portion being angled away from said horizontal exterior surface, wherein said closed end has a third external cross-sectional area equal to or smaller than said second external cross-sectional area through said containment portion such that said closed end may be vertically received into the standard test tube rack to hold said test tube and also such that said test tube is not vertically self-supporting on said closed end.

2. A test tube according to claim 1, wherein:

said means for stabilizing comprises a plurality of globs along said lower surface.

3. A test tube according to claim 1, wherein:

said means for stabilizing comprises a plurality of elongate legs along said lower surface.

4. A test tube according to claim 1, wherein:

said neck portion is angled approximately 45° relative to said containment portion.

5. A test tube according to claim 1, wherein:

said interior surface has a generally circular cross-section.

6. A test tube according to claim 1, wherein:

said tubular member is made of one of glass and plastic.

7. A test tube according to claim 1, wherein:

said exterior surface includes a lower surface, and said means for stabilizing said test tube is a plurality of legs provided along said lower surface.

8. A test tube according to claim 1, wherein:

said interior surface has a non-circular cross-section.

9. A test tube according to claim 1, wherein:

said open end of said tubular neck portion includes a lip.

10. A test tube according to claim 1, further comprising:

at least one side arm coupled to at least one of said containment portion and said neck portion.

11. A test tube according to claim 1, wherein:

said means for stabilizing said test tube is a non-circular cross-section provided to said exterior surface.

12. A test tube according to claim 11, wherein:

said exterior surface includes a flat lower surface.

* * * * *